US005709306A

United States Patent [19]

Hofmann

[11] Patent Number: 5,709,306

[45] Date of Patent: Jan. 20, 1998

[54] ADULT CONTAINER AND DISPENSER FOR SMALL ITEMS

[75] Inventor: Richard W. Hofmann, Chicago, Ill.

[73] Assignee: Magenta Corporation, Chicago, Ill.

[21] Appl. No.: 673,511

[22] Filed: Jul. 1, 1996

[51] Int. Cl.[6] ..... B65D 55/02

[52] U.S. Cl. ..... 206/536; 215/216; 215/225

[58] Field of Search ..... 215/329, 330, 215/216, 224, 225; 220/281, 253; 206/535, 536, 537, 533

[56] References Cited

U.S. PATENT DOCUMENTS 2,849,144 8/1958 Southwell ..... 215/224 X 5,372,267 12/1994 Hofmann ..... 206/536 X

*Primary Examiner*—Jacob K. Ackun

*Attorney, Agent, or Firm*—Laff, Whitesel, Conte & Saret, Ltd.

[57] ABSTRACT

An adult container according to the present invention comprises a container body and a cup-shaped closure which is installed telescopically over the open end of the container body. An annular rib, a plurality of longitudinal ramps and an annular groove and retaining lip are provided on the adjacent walls of the container body and the closure to coact with one another as the closure is longitudinally urged from a closed position to an open position. A cylindrical plug seal extends from a top wall of the closure to engage the open end of the container body when the closure is in the closed position. The closure has a side wall aperture which is unblocked to form a dispensing orifice when the closure is in the open position. The closure wall aperture is formed by relieving or omitting a portion of the cylindrical side wall of the closure from a bottom edge of the aperture through the top wall, with side edges extending parallel to a longitudinal axis of the closure.

6 Claims, 3 Drawing Sheets

FIG. 5
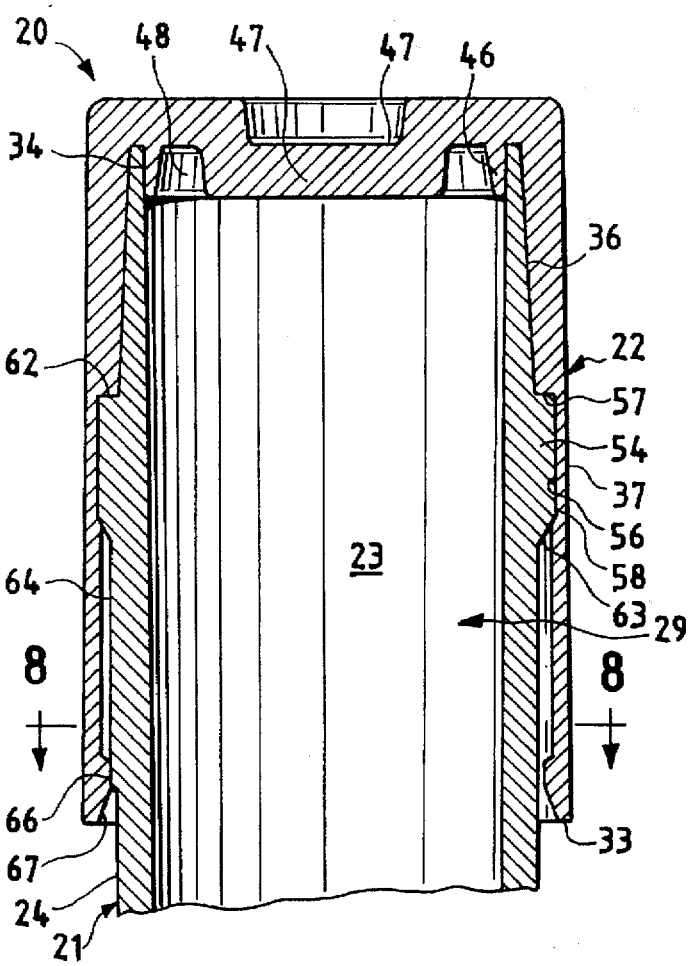
FIG. 6
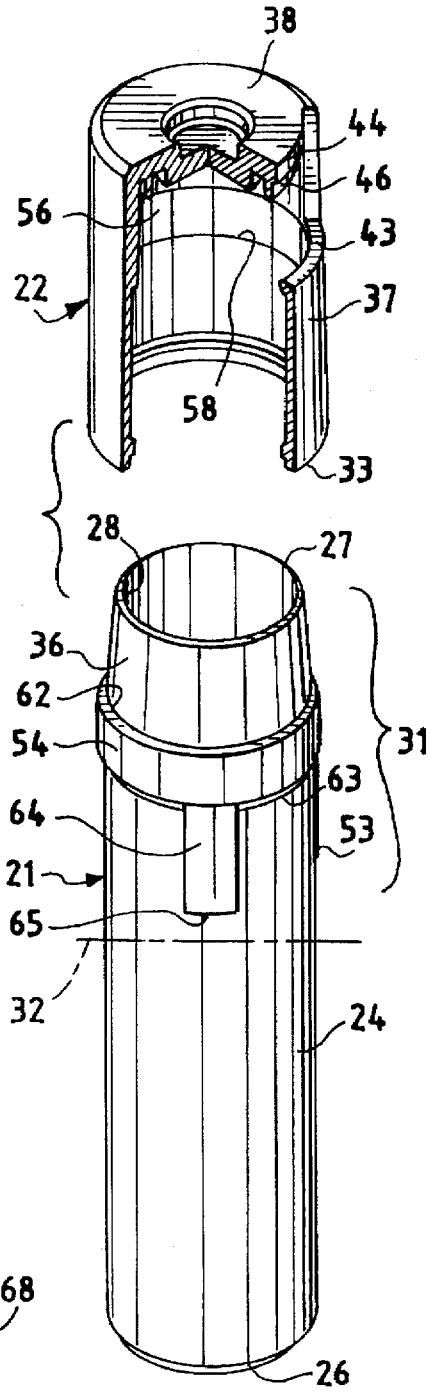
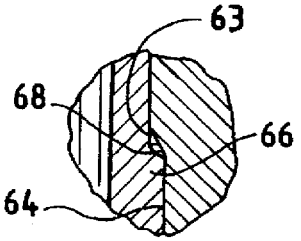
FIG. 7
FIG. 8
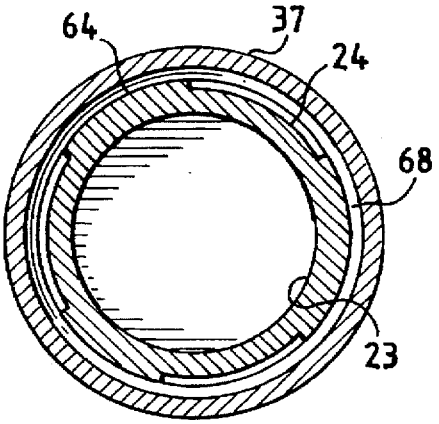

ADULT CONTAINER AND DISPENSER FOR SMALL ITEMS

FIELD OF THE INVENTION

This invention relates to containers for small items, and more particularly to containers for convenient use by an adult to store and dispense pills, capsules, or other small articles.

BACKGROUND OF THE INVENTION

A variety of products, such as medicines, dietary supplements, and the like, are distributed in the form of small pills, tablets, or capsules for use by adults who do not have any children and have been frustrated by the use of a variety of child-resistant containers which have been developed to contain such products, permitting access to the contents by adults while precluding access to the contents by children. However, many of these containers prevent access by older individuals.

Unfortunately, although some of these prior art containers and closure combinations are effective in preventing children from opening the container, they are sometimes also effective in preventing the intended adult users from readily opening the containers. Many potential users suffer from one or more conditions which impair their strength or manual dexterity, and some of these people find opening the prior-art containers difficult or impossible.

This is a significant disadvantage, because people who are ill and therefore need medication are the most likely to suffer from a condition which exacerbates the difficulty of opening child safety containers.

U.S. Pat. No. 4,971,203 to Weinstein discloses a child-resistant pill dispenser which dispenses a small number of items. Weinstein discloses a cylindrical container body having a closed end and an open end. A cup shaped closure having an inner diameter slightly larger than the outer diameter of the container is telescopically mounted to cover the open end of the container. In one embodiment, the closure has a retaining peg or cam which engages a retaining groove provided on the container. The retaining groove is generally circumferential, but has attached thereto an additional section extending longitudinally toward the open end of the container. The retaining groove and cam cooperate so that when the cam is in the circumferential portion of the groove, the closure may generally rotate but is retained in a first longitudinal position. However, when the closure is rotationally positioned so that the cam can follow the retaining groove's longitudinal extension, the closure may be longitudinally displaced a small distance away from the container's closed end to a second longitudinal position. (In another embodiment, a retaining groove is provided on the closure, and a cam is provided on the container, but the components cooperate in much the same way.)

A dispensing orifice is provided in the container body near the open end. This dispensing orifice is normally covered by the closure. However, the closure has a matching orifice which is so located that the two orifices are overlappingly aligned only when the closure is in its second longitudinal position. Thus, in order to dispense an item, the closure must first be rotated to a predetermined rotational position to align the cam with the retaining groove's longitudinal extension, and then must be longitudinally displaced to align the dispensing orifices.

The Weinstein dispenser suffers from several significant disadvantages. Because the retaining groove's longitudinal extension section is connected to the circumferential section, the extension portion needs to be discovered by rotating the closure while applying slight pressure in the direction of the extension. When the cam reaches the extension, a slight bump may be felt, or the cam may enter the extension. Thus an adult cannot easily and readily open the Weinstein dispenser but must first defeat its child-resistant feature.

Another disadvantage of the Weinstein dispenser is when the closure is in its open, longitudinally displaced position, items in the container may become lodged between the open end of the container and the closure, thereby preventing the closure from being returned to its normal (closed) position. Also, Weinstein lacks a seal between the container and the closure, permitting moisture and extraneous materials to enter the container, even when closed, thereby contaminating the contents.

Another disadvantage is that the Weinstein dispenser is expensive and difficult to construct with modern automated equipment. Weinstein's dispensing orifices are oval-shaped and positioned in a manner that makes fabrication by popular and inexpensive injection molding techniques difficult, and requires additional manufacturing operations. Also, due to the configuration of the retaining groove and mating cam, the closure and the container must be suitably oriented in a predefined relationship when assembled together. It may also be necessary to install the cam as a separate manufacturing operation after the closure and the container have been assembled.

SUMMARY OF THE INVENTION

It is therefore an object of the present invention to provide an adult container for pills, dietary supplements, and other items which allows adults to gain easy access to the contents of the container.

The invention provides an adult container having a container body and a telescoping closure. The container body may be substantially cylindrical and has a container body closed end and a container body open end. The closure is a cup-shaped closure which is installed telescopically over the open end of the container body.

At least one spline is arranged in a circumferential band on the exterior wall of the container body near the open end, and a corresponding annular slot is provided on the interior wall of the closure body. The container spline and the closure slot are positioned so as to interfere with one another when the closure is in a closed position. The interference is such that sufficient pressure on the closure will longitudinally urge the closure from a closed position to an open position.

A cylindrical lip having a diameter smaller than the diameter of the closure side wall extends inward from the closure top wall to form a seal. The cylindrical seal lip engages the upper container lip portion of the open end of container body when the closure is in the closed position, thereby preventing infiltration of moisture and other contaminants. A depression on the closure top wall fills some of the interior space in the vicinity of the closure seal to prevent stored items from interfering with the closure seal.

In one embodiment the container is adapted to conveniently dispense one or a small number of objects at a time. In this embodiment, the closure is generally cup-shaped, but has an aperture in its side wall. When the closure is in an open position, the closure wall aperture is located above the upper edge of the container body and forms a dispensing orifice through which items may be dispensed, one at a time. When the closure is in the closed position, the closure aperture is blocked by the body wall of the container body. The closure wall aperture is formed by relieving or omitting a portion of the cylindrical side wall of the closure from a bottom edge of the aperture through the top wall, with side edges extending parallel to a longitudinal axis of the closure. This enables the closure to be conveniently and inexpensively formed using modern injection molding techniques without requiring costly and time consuming side operations.

These and other features of this invention will be best understood by reference to the following detailed description of a preferred embodiment of the invention, taken in conjunction with the accompanying drawings.

BRIEF DESCRIPTION OF THE DRAWINGS

FIG. 5 is a partial side cross-section view of the container of FIG. 1, taken along section lines 5—5 thereof;

FIG. 6 is a front isometric view of the container of FIG. 1 showing separately a container portion and a closure portion partially cut away;

FIG. 7 is an enlarged detail of a portion of FIG. 4 taken along the view indicator 7 thereof, and;

FIG. 8 is a cross-sectional view taken along lines 8—8 of FIG. 5.

DETAILED DESCRIPTION OF THE PREFERRED EMBODIMENT

Figure 1:
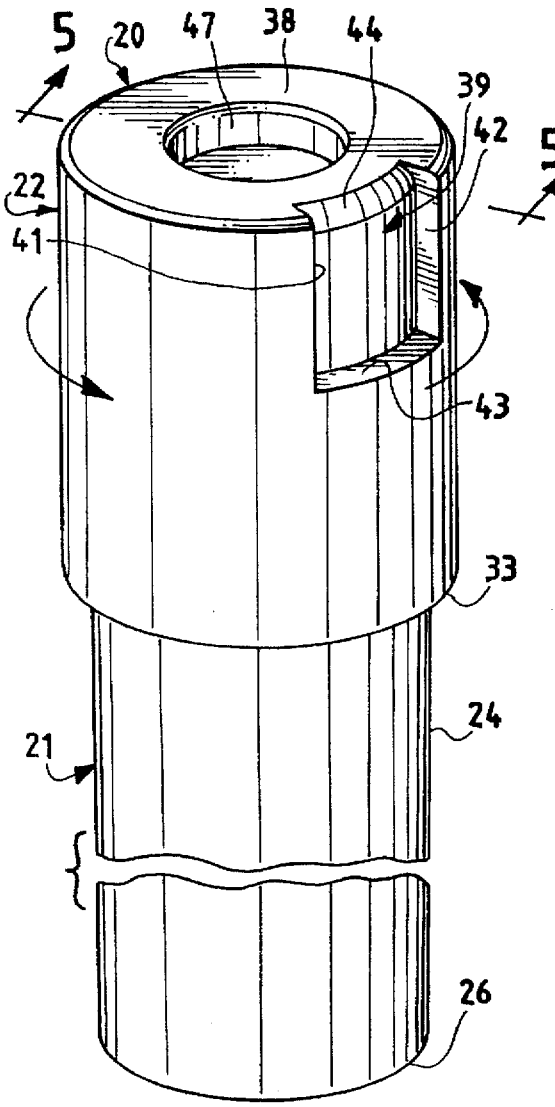
FIG. 1 is a front perspective view of a container constructed according to the present invention, showing the container fully assembled and in its closed state.

A preferred embodiment of an adult container constructed according to the present invention is shown in the drawings.

In brief, referring to FIGS. 1–5 an adult container 20 is intended to store a plurality of small items, such as pills, tablets, capsules, or the like, which are commonly used as delivery vehicles for medicines, dietary supplements, and other pharmacological products. Although it is contemplated that the adult container 20 is likely to be highly useful for storing ingestible, health-related products, the adult container would also be useful for storing any other small, discrete, substantially solid objects. For convenience, the term "items" is used herein to denote any object to be stored in the adult container 20.

Adult container 20 has a container body 21 and a mating closure 22. The container body 21 may be formed as an elongated tubular structure having a substantially cylindrical inner body wall 23 and outer body wall 24, a closed bottom end 26, and an open top end 27 (FIG. 2) defining container mouth 28. The inner body wall 23, closed bottom end 26, and container mouth 28 cooperate to define a container region 29 within the body 21 for containing objects of the type described above.

Although the container body 21 is shown in the drawings and described herein as substantially cylindrical. It is actually only necessary that the small upper portion 31 of the body 21 which interfaces with closure 22 has a particular shape to match the inner shape of the closure 22 (the portion 31 which is above the broken line 32 (FIG. 6). The remainder of the lower portion of the body 21 could be any suitable shape or cross-section, and could, for example, incorporate at least one flat surface (not shown) to prevent the container from rolling off an inclined surface. Furthermore, the particular shape of the closure interface section 31 may be selected from a variety of shapes which are generally rotationally symmetric about a longitudinal axis of the body 21. A body 21 having the substantially cylindrical shape shown herein is believed to be preferable because it may be efficiently and inexpensively manufactured using commonly available injection molding techniques.

Figure 3:
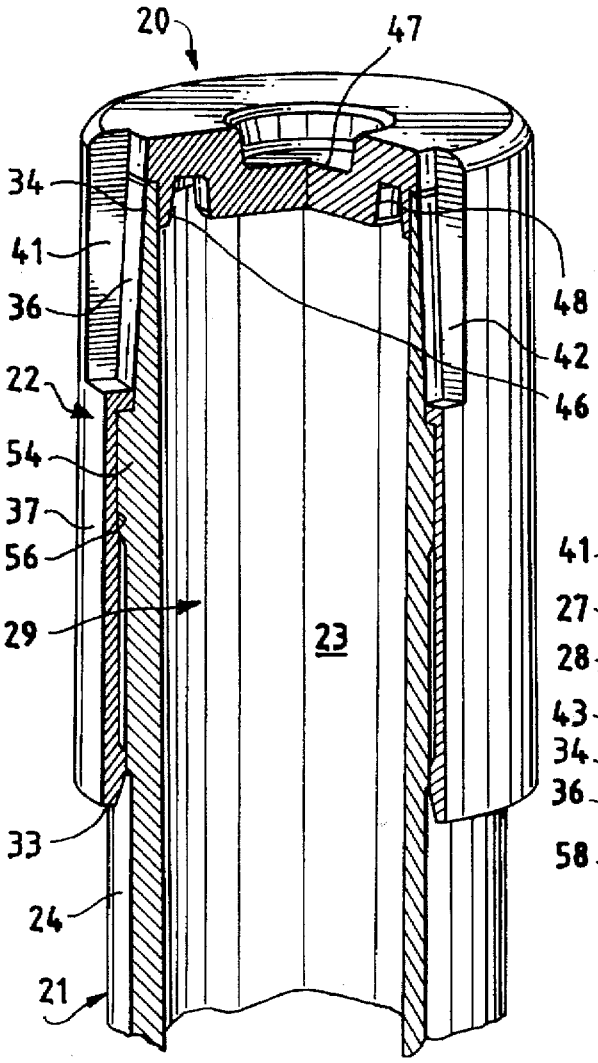
FIG. 3 is the front perspective of FIG. 1 with a portion cut-away.
Figure 4:
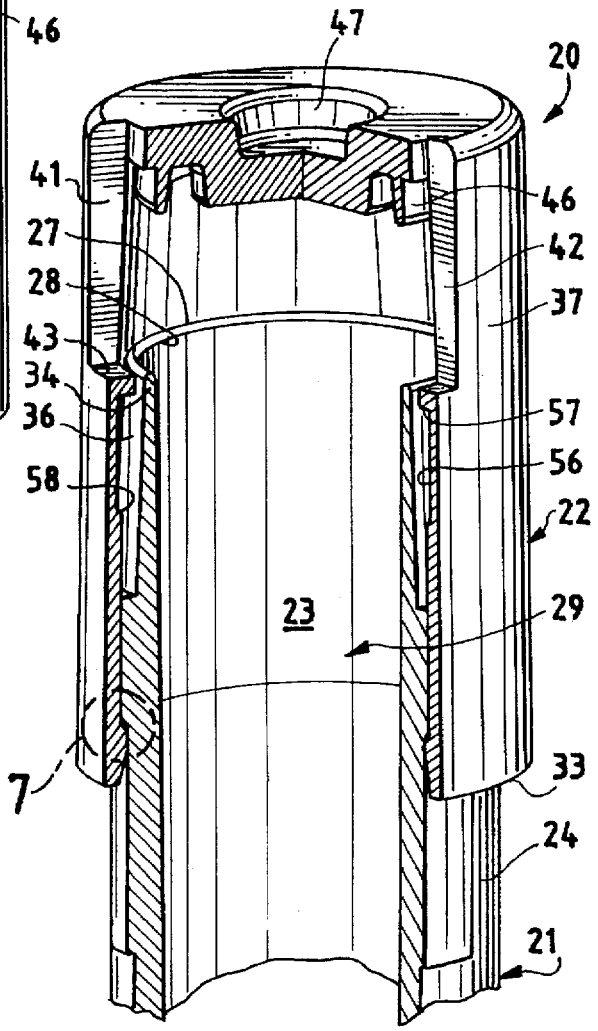
FIG. 4 is the front perspective of FIG. 2 with a portion cut-away.

As best seen in FIGS. 3–5, the closure interface portion of the body 21 extending above the broken line 32 (FIG. 6) is adapted to interface with the closure 22. As shown herein, the closure 22 is generally cup-shaped and has an inside diameter which is generally slightly larger than the outside diameter of the container body portion on which it slides. Thus, in order to close the container body 21, the open end 33 of the closure 22 is fit over the open end 27 of container body 21 in a generally overlapping telescoping relationship.

Also referring to FIGS. 5 and 6, the closure interface portion 31 comprises the open end 27 of the container body 21, an upper lip 34 of the body and transition section 36 of the outer body wall immediately below the lip 34. The transition section 36 has an outer frustro conical shape which is tapered so that its outside diameter is reduced as the open end 27 is approached.

The closure 22 is generally cup-shaped and comprises a substantially cylindrical body wall 37 having one end closed by an end wall, and the remaining end 33 open.

A dispensing orifice 39 is preferably provided in the wall 37. The dispensing orifice is defined by left and right side edges, 41 and 42, a bottom edge 43, and a top edge 44. The orifice may be created by relieving or omitting to form the portion of the wall 37 defined by these edges. Preferably, the omitted wall portion extends longitudinally upward from the bottom edge 43 through the top 24 of the closure, and the left and right side edges, 41 and 42 are preferably substantially parallel with the longitudinal axis of the closure 22. When commonly available injection molding techniques are used, these constraints permit the orifice to be molded in the direction of the draw and avoid the need for side actions, thereby reducing the cost and complexity of the mold, and improving the molding cycle time.

As best seen in FIGS. 3–6, the closure 22 preferably has a seal which cooperates with the container body 21 to seal the container when the closure 22 is in a closed position (see FIGS. 1, 3, and 5). The seal may be formed by any suitable seal, gasket, or the like. The seal is preferably formed as a cylindrical seal lip 46 which extends downward from the interior surface of the closure top wall. The cylindrical seal lip 46 thus forms a plug which extends into the open end 27 of the container body when the closure 22 is in the closed position (see FIGS. 3 and 5). Preferably, the cylindrical seal lip 46 is resilient and has an outer diameter which is slightly larger than the inner diameter of the upper container lip 34. When the closure 22 is urged downward into the closed position, the seal lip 46 is compressed radially inwardly, producing a tight interference seal with the inner surface of container lip 34. This seal advantageously prevents contaminants, such as dust and water vapor, from entering the container when it is intended to be closed.

The closure 22 preferably includes a depression 47 in the top wall. The depression 47 helps prevent items from catching on the closure lip 46, which otherwise might interfere with dispensing. An annular empty region or slot 48 is provided between the closure lip 46 and the depression 47 so that the depression does not affect the resilience of the lip 46 or its movement when being compressed.

Figure 2:
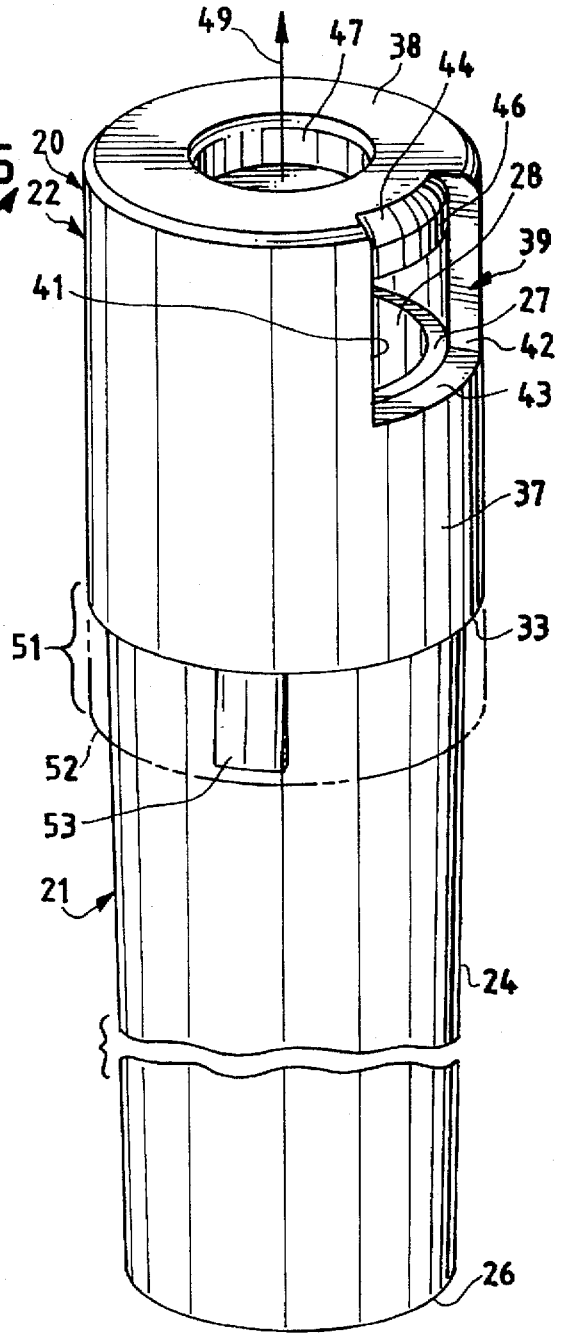
FIG. 2 is a front perspective view of the container of FIG. 1, showing the container in its open state.

As best seen in FIGS. 1–5, when the container body 21 and the closure 22 are assembled to form the adult container 20, the closure 22 has a closed position (FIGS. 1, 3, and 5), and an open position (FIGS. 2 and 4) in which the closure 22 is displaced upwards (indicated by arrow 49) by a distance 51 from the closed position (indicated in FIG. 2 by the phantom line 52).

Although any appropriate cooperative locking means could be used, a preferred locking mechanism according to the present invention incorporates an annular spline or rib 54 on the container body spaced a predetermined distance from the open end 27, and a corresponding annular slot 56 on the interior surface of the closure body 37 for receiving the annular spline 54. The slot 56 is preferably formed by an upper circular flat wall 57 and a lower frustro-conical wall 58 having its frustro apex joining the inner surface of the closure. The groove upper wall 57 is wider than the groove lower wall 58.

As best seen in FIG. 5, when the closure 22 is in the closed position, the annular rib 54 has a flat circular top wall 62 which abuts the top wall 57 of the closure groove 56. The annular rib has a frustro-conical bottom wall 63 wherein the frustro apex thereof joins the container wall 21 and a plurality of longitudinal pads or ramps 64 as hereinafter described. The rib bottom wall 63 has substantially the same degree of slope as the groove lower wall 58. In the closed position shown in FIG. 5, the rib bottom wall 63 contacts the groove bottom wall 58 and the friction between the two walls 58 and 63 locks or holds the closure 22 closed onto the container body 21. Also, the friction between the lip 34 and the closure lip 46 acts as a friction locking mechanism for the closure. Thus, in all angular orientations of closure 22 with respect to container body 21, the annular rib bottom wail 63 and the closure groove bottom wall 58 along with the lip 34 and closure lip 46 to inhibit the closure 22 from inadvertently moving upward into the open position.

The container body preferably has a plurality of pads or ramps 64 that are integral with and extend longitudinally from the bottom of the annular rib 54 towards the container bottom 26. For appearances, the ramps 64 have ends 65 that generally do not extend below the closure open end 33 when the closure is in the closed position of FIGS. 1, 3 and 5. The ramps do not provide any locking interference with the closure end 33.

When referring to FIG. 8 the three ramps 64 are preferably spaced from their respective center lines 135°, 120° and 105° from each other. However, other spacing is possible. When referring to FIG. 5, when the container 20 is closed, a lower inner ring shaped lip 66 of the closure wall 24 contacts the outer surface of the ramps and is spaced from the outer wall of container body.

Instead of a plurality of ramps, there may be a single ramp.

Also, if desired, the outer diameter of the ramps may have a diameter slightly larger than the inner diameter of the lip 66 in its uninstalled condition as shown in FIG. 6. The outward flexing of the cover by the ramp 64 causes the cover to press against the ramp with a desired amount of force that also aids in maintaining the cover closed while the container is not being used.

Because adult container 20 conveniently dispenses the items stored therein as the user requires them, there is generally no need for the closure 22 to be separated from the container body 21 after the container has been filled and those parts have been assembled together. Further, if the closure 22 is separated from the container body 21, it may be lost. Accordingly, the closure 22 comprises means to retain it in operative attachment to the container body. The ring-shaped lip 66 projects inward from the interior of the side wall 37 of the closure near the open bottom end 33 thereof and above the bottom end 65 of the ramps 64. In order to assemble the closure 22 to the container body 21, the closure 22 is installed over the open end 27 of the container body, and sufficient downward pressure is supplied to radially move the closure end and body wall 37 outward, so that the end and lip 66 may pass the container body annular rib 54. A chamfered lower edge 67 is provided on the inner surface of the closure end 33 to urge it to deform outwardly as it bears against the top of the rib or spline 54.

In normal operation (i.e., once the container body 21 and the closure 22 have been assembled), when the closure 22 is moved to its open position, the upper surface 68 of the lip 66 interferes with the bottom face 63 of the annular rib 54. The rib 54 effectively blocks the lip 66 from passing over the rib 54. Thus, once assembled to the container body 21, the closure 22 cannot be removed unless sufficient upward and outward force is applied to deform the lip 66 so that it may pass over the annular rib 54. In order to raise the closure 22 into the open position, a user must apply upward pressure on the closure 22. When light to moderate upward pressure is initially applied to the closure, the groove bottom wall 58 (FIG. 5) slides on the rib bottom wall 63 and the closure flexes outwardly and releases the frictional interference between the groove and rib bottom walls 58 and 63 and releases the frictional engagement between the annular seal 46 and the closure lip 34. The closure then moves upward in the direction of the arrow 49 (FIG. 2). The closure slides upwardly until the edge of lip upper face 68 abuts the rib face 63 (FIG. 7).

The container body 21 and the closure 22 are preferably constructed of a suitable resilient plastic material, such as polyethylene, a polyacrylic ester, or polypropylene.

The diameter of the closure bottom wall 33 may depend in part on the particular material from which the container 21 and closure 22 are constructed, and in part on other dimensions, such as the thickness of the upper and bottom closure and upper and bottom container walls and the diameter of these parts. Thus, selecting a suitable width may be important in providing a container which does not pose an unacceptable access barrier to intended users, who may have impaired strength and manual dexterity.

Although the previous discussion of the adult container and the associated figures have shown a particular arrangement of a rib and a corresponding groove, other arrangements could also be used.

The above-described embodiments of the invention are merely examples of ways in which the invention may be carried out. Other ways may also be possible, and are within the scope of the following claims defining the invention.

I claim:

1. An adult container comprising:

a container body, said container body having a substantially cylindrical side wall portion, and an open end;

a closure, said closure having a substantially cylindrical body wall, an orifice defined by said closure, and an open end wall, said orifice opening through said cylindrical body wall, said cylindrical side wall portion for interfacing with said closure;

at least one rib provided on said container body or said closure and a corresponding groove on the other of said container body or said closure, wherein said at least one rib, corresponding groove, closure cylindrical body wall, and container body cylindrical side wall forming means for telescopically engaging said closure to said container body during and after an adjustment of said closure along a longitudinal length of said container body to an open and a closed position, wherein said at least one rib and corresponding groove have a releasable frictional locking fit for retaining said closure in a selected position along said longitudinal length of said container body, and wherein said releasable frictional locking fit can be unlocked, with said closure in any circumferential position relative to said container body.

2. The container of claim 1 wherein said selected position is selected from a group of positions consisting of said closed position and said open position.

3. The container of claim 1 wherein said at least one rib is an annular rib arranged cylindrically about said container body side wall and extending radially outward therefrom.

4. The container of claim 3 wherein:

said container includes at least one longitudinal ramp integral with said container body, said ramp positioned below said annular rib;

an interference lip is on the inner surface of said closure, said interference lip being sized to provide contact with the bottom surface of said annular rib when said container is in said open position to prevent said closure from being removed from said container body.

5. The container of claim 1 wherein:

the closure in the open position, said orifice is at least partially unobstructed by said, container body and said container has an axial length greater than an axial length of the container when the closure is in the closed position.

6. An adult container comprising:

a container body and a closure;

said container body having a portion for interfacing with said closure;

said interfacing portion having a substantially cylindrical side wall and an open end;

said closure having a substantially cylindrical body wall and an open end wall;

said closure adapted to telescopically engage said interfacing portion of said container body;

said closure and said interfacing portion having releasable corresponding frictional locking means for retaining said closure in a predefined longitudinal position with respect to said container body;

said frictional locking means comprising at least one rib provided on one of said container body or said closure, and a corresponding annular groove on the other of said container body or said closure, wherein said at least one rib and said corresponding groove are sized to permit the closure to be unlocked in any circumferential position, wherein said closure is adapted for longitudinal movement with respect to said container body and said frictional locking means interferes with said longitudinal movement when said closure is in its closed position, wherein said at least one rib is an annular rib arranged cylindrically about said container body side wall and extending radially outward therefrom, wherein said container includes at least one longitudinal ramp integral with said container body and positioned below said annular rib, an interference lip on the inner surface of said closure, said interference lip being sized to provide contact with the bottom surface of said annular rib when said container is in an open position to prevent said closure from being removed from said container body, and wherein said closure has a cylindrical seal lip extending downwardly towards the container body from a closure end wall and spaced inwardly from the closure body wall to provide an annular closure slot, said annular closure slot being sized to receive in a frictional interference seal fit a lip portion of the container body open end and the outer diameter of the cylindrical seal lip being slightly larger than the inner diameter of the container body adjacent to said container body lip portion.

* * * * *

UNITED STATES PATENT AND TRADEMARK OFFICE

CERTIFICATE OF CORRECTION

PATENT NO. : 5,709,306
DATED : January 20, 1998
INVENTOR(S) : Richard W. Hofmann It is certified that error appears in the above-indentified patent and that said Letters Patent is hereby corrected as shown below:

Column 4, Line 37, "top 24" should be --top 38--

Column 5, Line 37, "wail 63" should be --wall 63--

Column 7, Line 33, "said, container" should be --said container--

Signed and Sealed this

Ninth Day of June, 1998

*Attest:*

*Attesting Officer*

Bruce Lehman

BRUCE LEHMAN

*Commissioner of Patents and Trademarks*